US005457464A

United States Patent [19]

Scott et al.

[11] Patent Number: 5,457,464

[45] Date of Patent: Oct. 10, 1995

[54] TRACKING SYSTEM

[76] Inventors: David Scott; Brian C. L. Scott, both of 220 Northgate Street, Great Yarmouth, Norfolk, Great Britain

[21] Appl. No.: 90,131

[22] PCT Filed: Jan. 14, 1992

[86] PCT No.: PCT/GB92/00079

§ 371 Date: Nov. 5, 1993

§ 102(e) Date: Nov. 5, 1993

[87] PCT Pub. No.: WO92/12551

PCT Pub. Date: Jul. 23, 1992

[30] Foreign Application Priority Data

Jan. 14, 1991 [GB] United Kingdom ..... 9027399

[51] Int. Cl.[6] ..... H01Q 3/12

[52] U.S. Cl. ..... 342/352; 342/75

[58] Field of Search ..... 342/74, 75, 77, 342/147, 352, 354

[56] References Cited

U.S. PATENT DOCUMENTS

| | | | |
|---|---|---|---|
| 3,859,658 | 1/1975 | Rabow | 342/149 |
| 4,010,472 | 3/1977 | Mountcastle et al. | 343/761 |
| 4,156,241 | 5/1979 | Mobley et al. | 342/352 |
| 5,089,824 | 2/1992 | Uematsu et al. | 342/359 |

*Primary Examiner*—Mark Hellner

*Attorney, Agent, or Firm*—Galgano & Burke

[57] ABSTRACT

A tracking system for enabling maintenance of alignment between a receiver of electro-magnetic radiation and a source of electro-magnetic radiation signals, the system comprising: a receiver; a sensor associated, in use, with the receiver to sense the strength of the signal received by the receiver; and an interrupter device, which in use, intermittently interrupts one or more discontinuous eccentric portions of the signal being received by the receiver thereby attenuating the received signal by an extent which is dependent upon the degree of misalignment of the receiver from the transmitter.

13 Claims, 7 Drawing Sheets

TRACKING SYSTEM

FIELD OF THE INVENTION

The present invention relates to a method and means for monitoring alignment of a receiver of electro-magnetic radiation with a source of electro-magnetic radiation. More particularly, but not exclusively, the present invention relates to a method and means for monitoring and maintaining alignment of a satellite transmission receiver dish and a satellite transmitter when either or both the source and the receiver are not geostationary.

BACKGROUND TO THE INVENTION

Receivers for satellite television generally comprise a parabolic dish having a dipole at its centre to collect the high frequency electro-magnetic radiation transmissions from a satellite television transmitter in geostationary orbit. The effectiveness of reception by the receiver is heavily reliant upon maintenance of alignment of the dish with the transmitter. This poses a considerable problem where the satellite receiver dish is mounted to a vehicle or vessel, such as a ship, which is moving relative to the surface of the earth.

Amongst the systems which have been developed to overcome this problem are a simple gyroscopic mounting for use on sea-going vessels to compensate for rolling motion of the vessel, and a system which has been developed for use on buses which comprises a sensory device having three zones positioned to enable detection of two axes of skew of the signal received from the transmitter by comparing the time delay in reception of signal by each of the zones. Neither of these systems is suitably rapid, efficient and effective in operation.

SUMMARY OF THE INVENTION

According to a first aspect of the present invention there is provided a tracking system for enabling maintenance of alignment between a receiver of electro-magnetic radiation and a source of electro-magnetic radiation signals, the system comprising: a receiver; a sensor associated, in use, with the receiver to sense the strength of the signal received by the receiver; and an interrupter device, which in use, intermittently interrupts one or more discontinuous eccentric portions of the signal being received by the receiver thereby attenuating the received signal by an extent which is dependent upon the degree of misalignment of the receiver from the transmitter.

Preferably means are provided to synchronise operation of the sensor with operation of the interrupter device.

Preferably the interrupter device interrupts a pair of portions of the signal received.

Preferably the pair of portions are substantially radially opposing.

Yet more preferably, the interrupter device interrupts two pairs of portions, each pair lying substantially along a respective one of the transverse horizontal (side-to-side) and vertical (top-to-bottom) axes of the receiver.

Preferably the system further comprises an automatic comparator for comparing the received signal as attenuated by interruption of one of said pair of radially opposing with the received signal as attenuated by interruption of the other of said pair and providing an output signal corresponding to the difference between each compared pair of received signals.

Preferably the system further comprises an orthomode transducer and a pair of receiver elements.

The system suitably further comprises a corrective transport mechanism which acts to re-align the receiver with the transmitter in response to control signals which correspond to the output signals from the comparator.

Preferably the receiver is of cassograin-type and the interrupter device comprises a reflector onto which the dish of the receiver focuses and which directs the received signals as a beam of electro-magnetic radiation to the transducer of the receiver, the reflector having one or more eccentric apertures therein to interrupt portions of the signal, the reflector being rotated, in use, such that samples of attenuated signal strength may be taken when the interrupted portion is at different radial positions relative to the focused beam of electro-magnetic radiation.

Advantageously the reflector comprises two reflective plates one mounted behind the other and each having one or more apertures therein corresponding to apertures in the other, one of the plates being stationary in use and the other rotary such that signal strength is only attenuated when the apertures are aligned.

In an alternative where the interrupter device is directly in a line between the collector and transducer of the receiver the interrupter may comprise an element which is electronically activated to obstruct the path of beam. The element may comprise, for example one or more retractable arms or an LCD screen which transmits the electro-magnetic radiation when not energised.

According to a second aspect of the present invention there is provided a method for monitoring alignment of a receiver of electro-magnetic radiation with a selected source of electro-magnetic radiation, which method comprises the steps of: Providing a system of the first aspect of the present invention; taking a first sample of the received signal strength during momentary attenuation of the signal while the signal is interrupted by the interrupter device at a first position toward a first side of the receiver and taking a further sample of attenuated signal strength when the interrupter device is operative at a second position toward the opposing side of the receiver; and comparing the attenuated signal strengths from the sample taken at the first position and the sample taken at the second position to provide a signal representative of the difference between the two samples and indicative of lateral, or azimuth, error in alignment of the receiver and source.

Preferably further attenuated signal strength samples are taken when the signal being received is interrupted at third and fourth positions respectively disposed toward the top and bottom, in use, of the receiver; and comparing the attenuated signal strengths corresponding to the third and fourth positions to provide a signal corresponding to the difference between the two sample signal strengths and indicative of elevation errors in alignment between the source and receiver.

The method preferably further comprises the provision of two receiver elements adapted such that one can receive horizontally polarized signals and the other can receive vertically polarized signals; sampling the signal strength from each of the two receivers and comparing the signal strengths to provide a resultant differential signal indicative of rotary phase misalignment of the receiver and source.

Preferably the transmitted signals are received by each of the receiver elements through an orthomode transducer with the signal entering one of the two receiver elements being offset relative to the signal entering the other by an angle of above or below 90 degrees.

According to a third aspect of the present invention there is provided a component of a tracking system of the first aspect which comprises an interrupter device.

BRIEF DESCRIPTION OF THE DRAWINGS

A preferred embodiment of the present invention will now be more particularly described by way of example and reference to the accompanying drawings, wherein.

DESCRIPTION OF THE PREFERRED EMBODIMENTS

Figure 1:
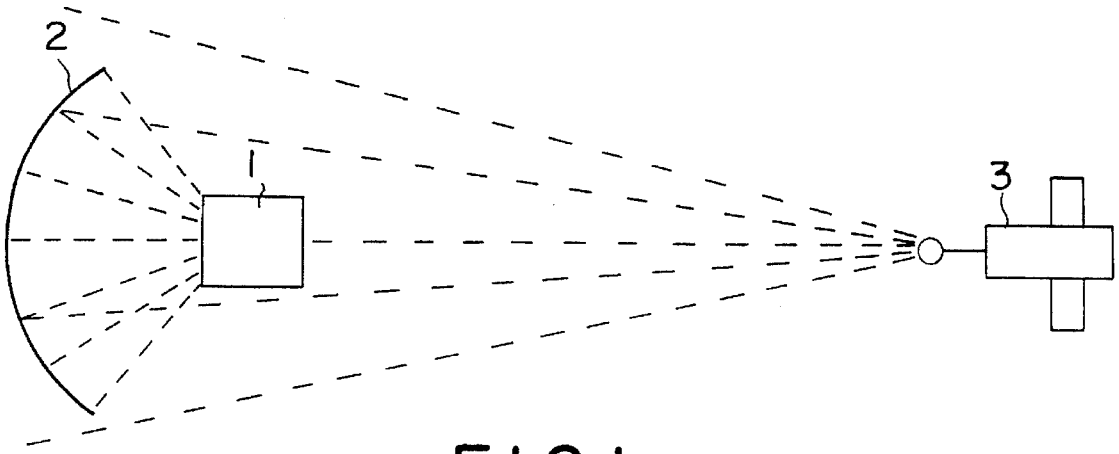
FIGS. 1 and 2 are schematic horizontal sectional views through a satellite television receiver illustrating alignment and misalignment respectively relative to a transmitting satellite in geostationary orbit.

Referring to FIG. 1, there is shown a satellite transmission receiver comprising a transducer/receiver element 1 and a parabolic reflector dish 2 focusing the signals received from a transmitter 3 in geostationary orbit. In this illustration it will be seen that the dish 2 of the receiver is substantially aligned with the transmitter 3 such that signals from the transmitter are reflected from the dish 2 and focussed substantially evenly onto the transducer/receiver element 1.

Figure 2:
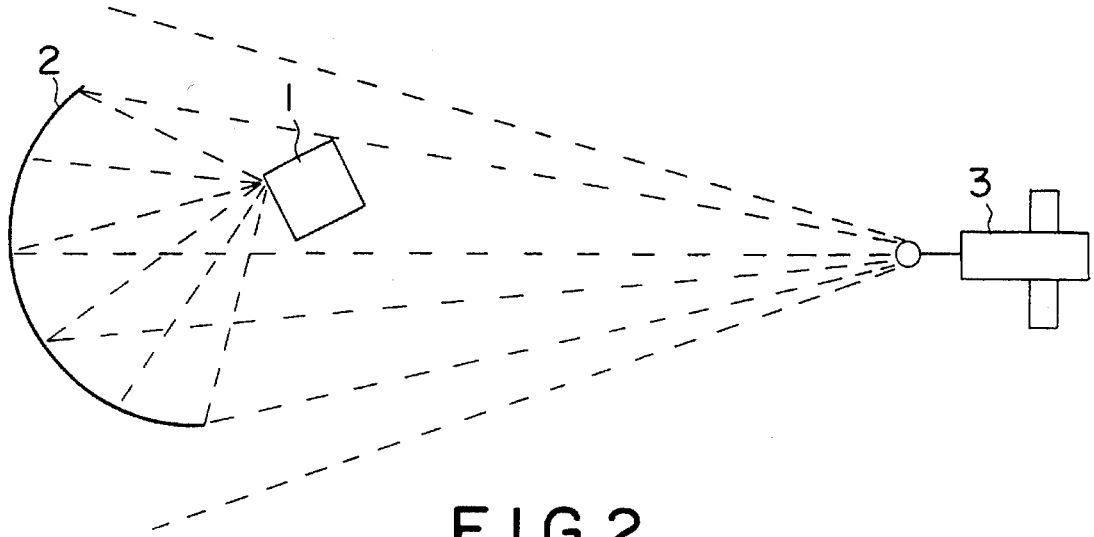

When, however, misalignment of the dish 2 relative to the transmitter 3 occurs there is a directional shift in the manner in which the signals are reflected onto the receiver element 1 as illustrated by way of example in FIG. 2.

The receiver dish in FIG. 2 is oriented leftwardly of the orientation of the satellite transmitter 3 from the receiver. This situation would arise, for example, where the receiver is mounted aboard a ship which rolls or yaws to port. The electro-magnetic radiation signals received from the transmitter 3 are accordingly focused onto the receiver element 1 toward the left-hand side thereof. Inevitably misalignment of the receiver dish 2 relative to the transmitter 3 reduces the effectiveness of signal reception by the receiver.

Figure 3:
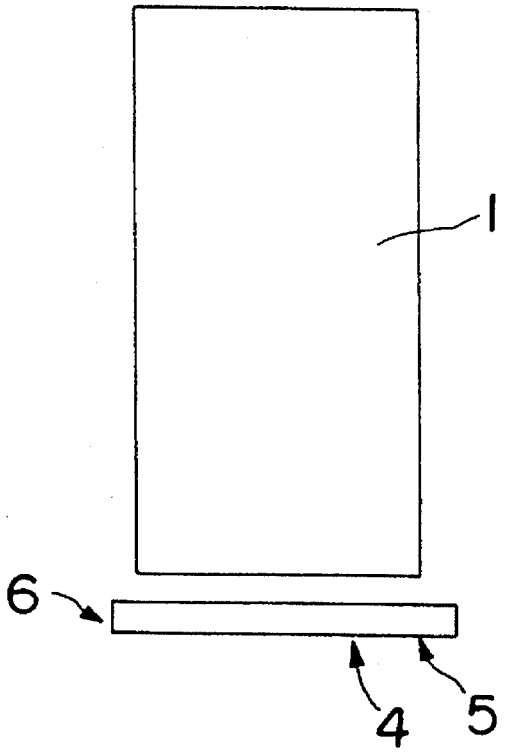
FIGS. 3 and 4 are plan and front elevation views respectively of the receiver of FIGS. 1 and 2 and showing mounting of an interrupter device at the signal receiving end of the receiver element.
Figure 4:
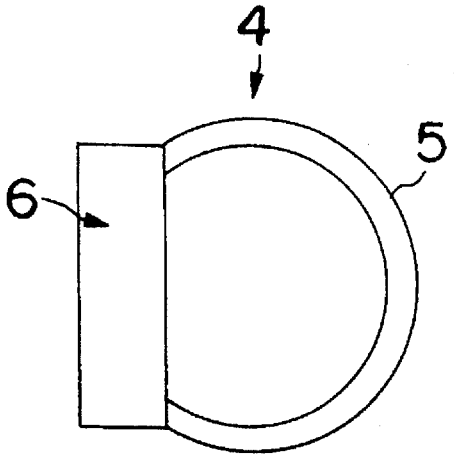

FIGS. 3 and 4 illustrate a rudimentary form of interrupter device 4 comprising an annular body 5 having a rectangular signal obstructive plate 6 integrally formed thereon or mounted thereto extending eccentrically thereof. The interrupter device 4 is rotatably mounted, in use, in front of the receptive surface of the receiver element 1 such that the obstructive plate 6 of the interrupter device 4 may sweep an annular zone of the front face of the receiver element 1 as the interrupter device 4 is powered to rotate.

A micro processor unit or other suitable electronic circuitry and a signal strength sensor (not shown) are provided to take successive samples of the strength of signal received by the receiver element 1 at preselected stages in the revolution of the interrupter device 4 corresponding to interruption of the signal at each of four quadrants: Top, bottom, left and right of the receptive face of the receiver element 1.

The micro processor ensures syncronisation of signal strength sampling with appropriate positioning of the obstructive plate 6 of the interrupter device 4. The micro processor further acts as a comparator to compare substantially contemporaneous signal strength readings from radially opposing quadrants of the receptive face of the receiver element 1.

Figure 5:
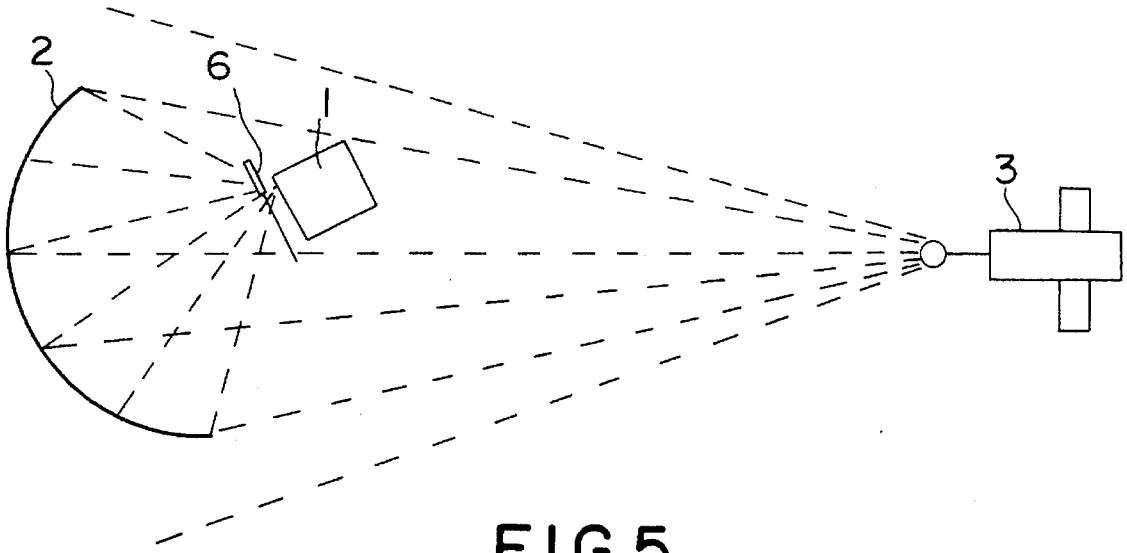
FIGS. 5 and 6 are schematic horizontal sections views of the system of FIG. 1 and illustrating operation of the interrupter device of FIGS. 3 and 4.
Figure 6:
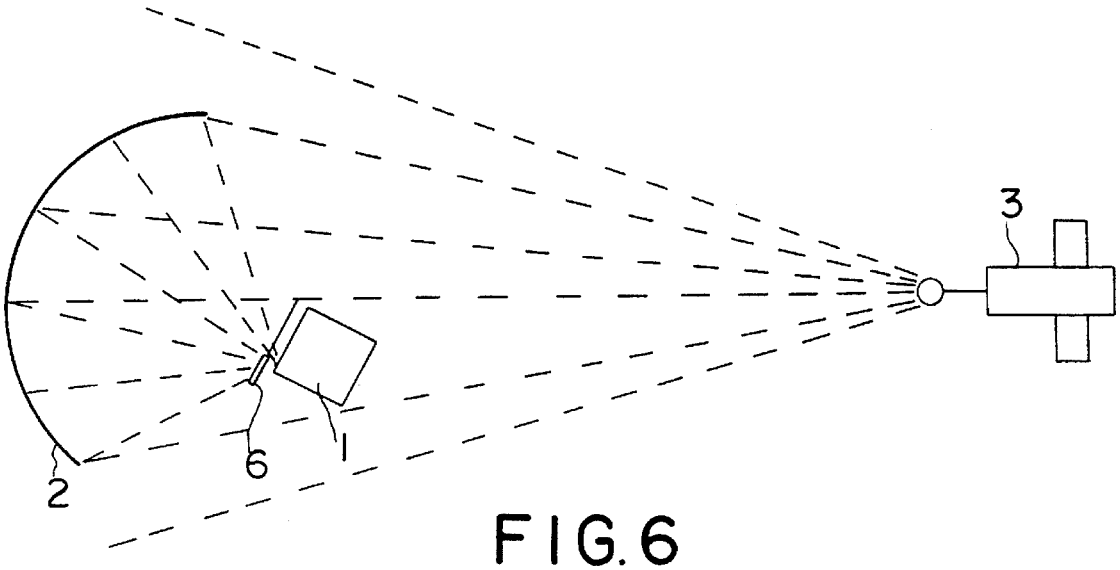
Figure 7:
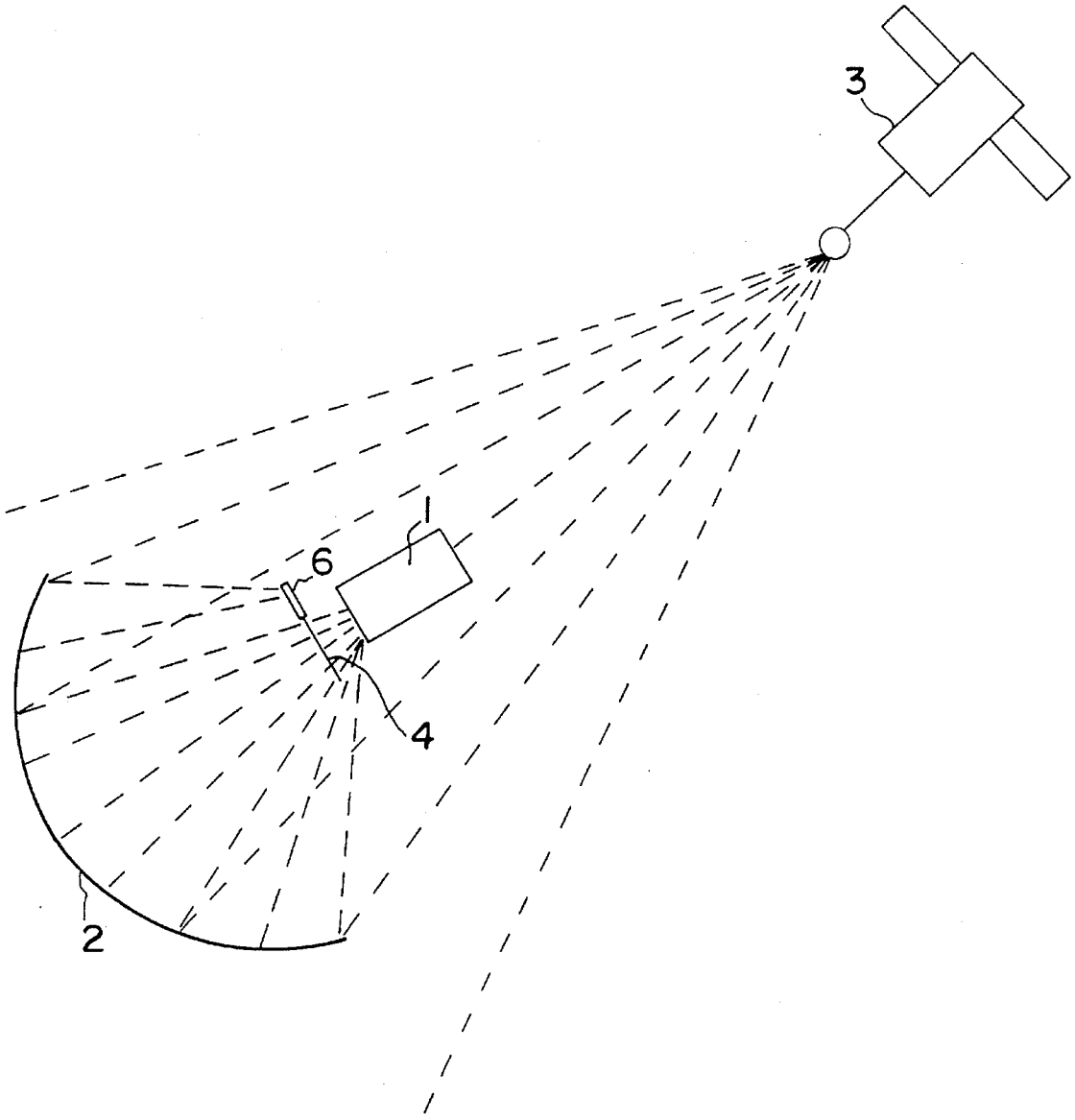
FIG. 7 is a vertical sectional view of the system shown in FIGS. 5 and 6.
Figure 8:
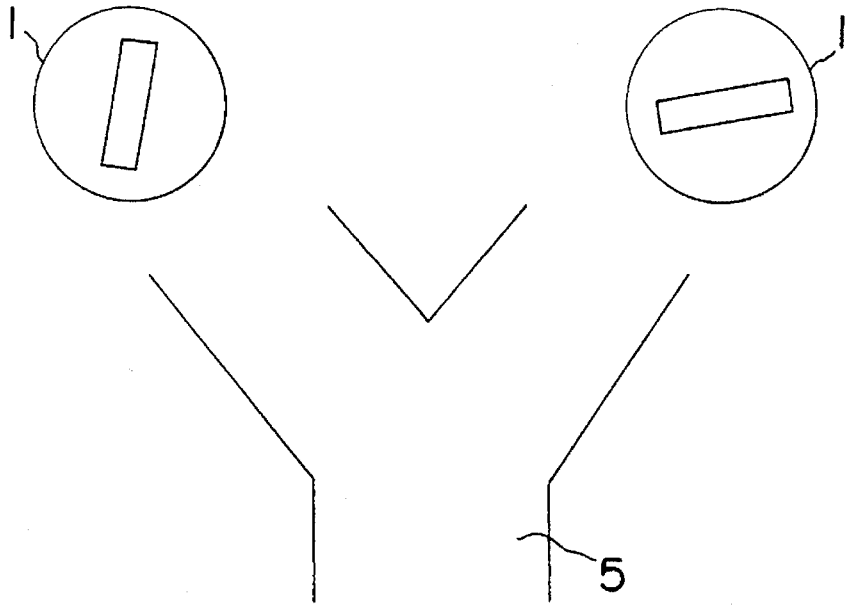
FIGS. 8 and 9 are schematic views of an array of receiver elements for assessing rotary phase misalignment of the receiver and transmitter.
Figure 9:
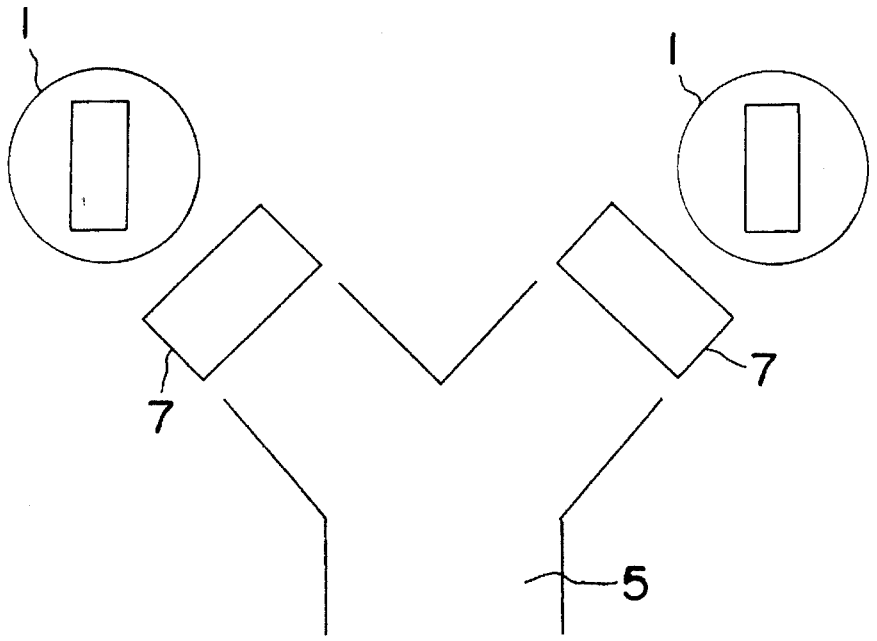

Referring to FIGS. 5 and 6, the operating principle of the interrupter device 4 will now be described. In the situation illustrated in FIG. 5 the receiver dish 2 is skewed to the left of the transmission path from the satellite transmitter 3. The obstructive plate 6 of the interrupter device 4 interrupts a greater proportion of the signal than would be the case when the transmitter 3 and receiver dish 2 are in alignment. In consequence, the received signal is attenuated by a large degree. As the interrupter device 4 continues to rotate and a successive sample of signal strength is taken as the plate 6 swings around to the right-hand side of the receiver element 1, comparison of the attenuated signal strength from interruption of the signal at the right hand side with interruption of the signal at the left-hand side gives rise to a resultant differential measurement indicative of skew of the receiver to the left of the axis of alignment with the transmitter 3.

In the converse situation where the receiver has swung rightwardly from alignment with the transmitter 3, the received signals reflected by the parabolic reflector 2 onto the receptive surface of the receiver element 1 will be focused toward the right side thereof and will be comparatively weakly attenuated by the obstructive plate of the reflector device 4 when the plate 6 is positioned over the left hand side of the receiver element 1. When the obstructive plate 6 of the interrupter device 4 reaches the right-hand side of the receiver element 1 attenuation of the signal will be greatly increased. Again, comparison of the attenuated signals from interruption at right and left sides when compared will give a resultant differential indicative of the rightward skew of the receiver dish 2 relative to the axis of alignment with the transmitter 3. The resultant differential measurements from continuous monitoring of the attenuated signal strengths received by receiver element 1 are processed by the micro processor to generate control signals for operating a corrective mechanism to realign the receiver with the transmitter. This mechanism (not shown) may suitably comprise a plurality of stepper motors, for example.

In similar fashion to the monitoring of left-right skew of the receiver relative to the transmitter, elevational misalignment is monitored by comparison of attenuated signal strengths sampled when the interrupter device 4 interrupts portions of the received signal at top and bottom of the receiving element 1.

Rotary phase misalignment of transmitter and receiver may be monitored and consequentially rectified where the transmission is of polarized nature by use of two receiving elements 1 either arranged adjacent each other and angled apart by slightly greater or less than 90 degrees or adapted by provision of a polarotor 7 to respectively receive either the horizontally polarized signal or the vertically polarized signals. An orthomode transducer 5 serves to direct the signal to both receiver elements 1.

By comparing the signal strength of the output of the two receiver elements 1 any rotary phase misalignment can be measured and subsequently rectified by the corrective mechanism.

Figure 10:
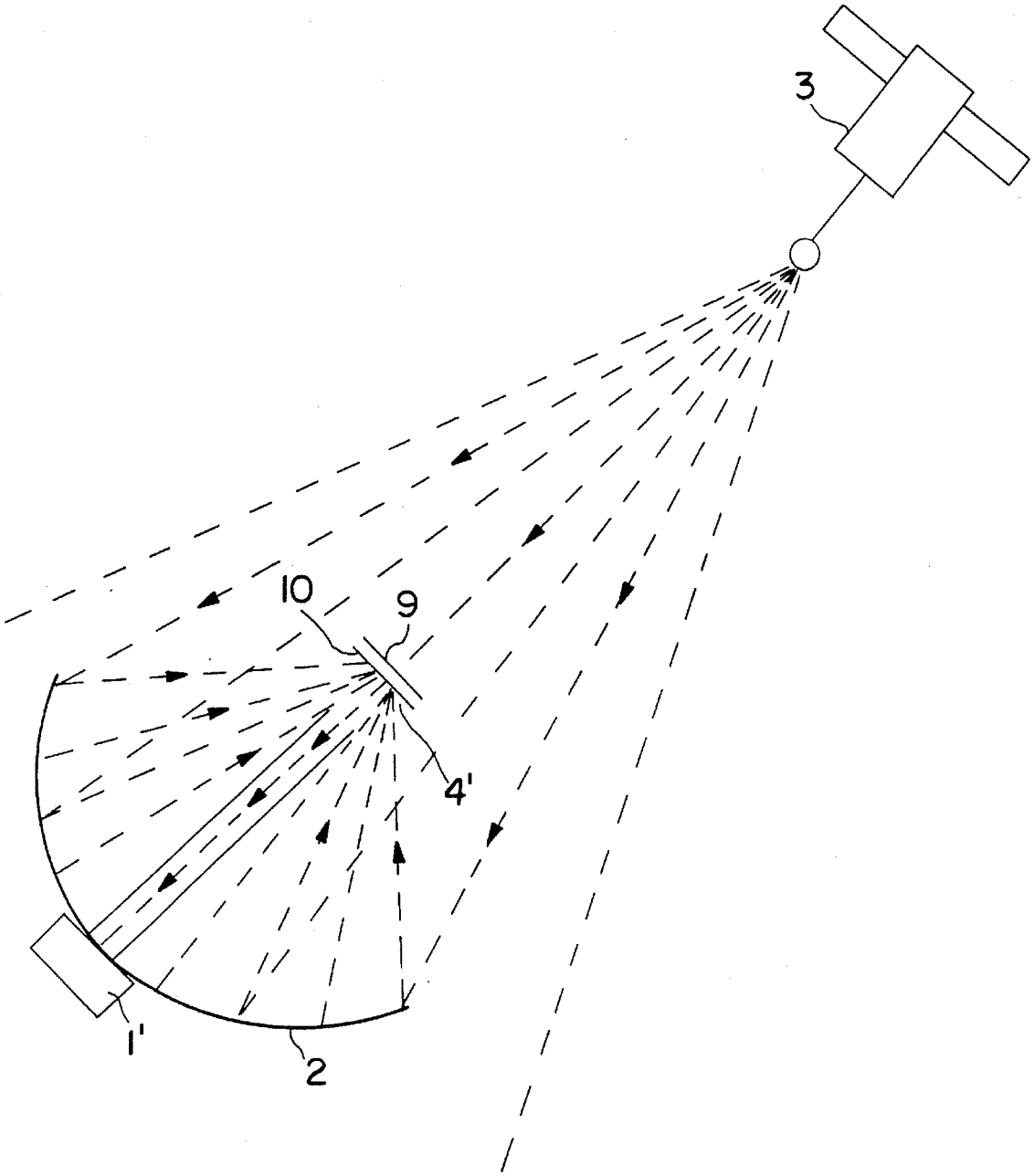
FIG. 10 is a vertical sectional view of a cassograin-type receiver illustrating operation of an interrupter device of a second preferred embodiment of the invention.
Figure 11:
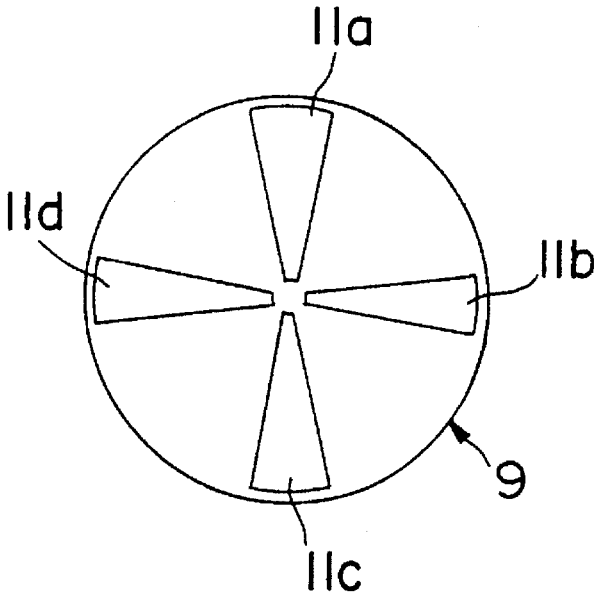
FIGS. 11 and 12 are rear elevation views of the of the second preferred embodiment.
Figure 12:
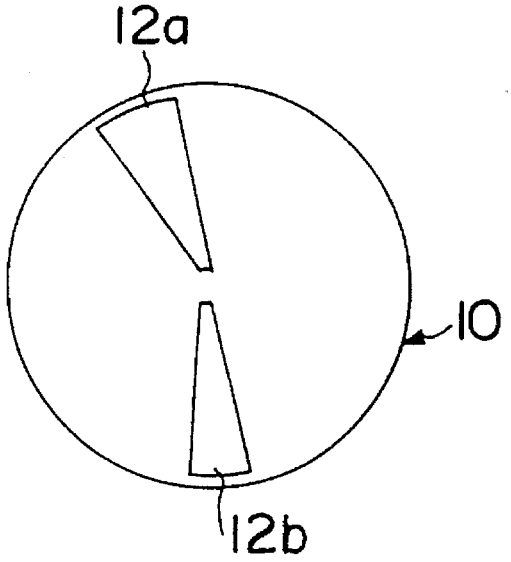

Referring now to FIGS. 10–12 there is shown an improved form or interrupter device 4' mounted to a specially adapted cassograin type of receiver. The interrupter device 4' comprises a pair of reflective plates 9, 10 which are substituted for the conventional sub-reflector of the cassograin type receiver to selectively reflect the transmitted signals focused thereon by the parabolic reflector 2' down through a feed tube 11 to the receiver element 1' mounted substantially centrally to the rear of the dish 2'.

The reflective plates 11, 12 are disc-shaped and each have substantially radially opposing apertures extending therethrough. One of the two discs or plates 9, 10 has four substantially equally spaced apertures 11*a–d* therein each of an area less than or equal to 1/16 of the area of the disc. The other disc 10 has only two such apertures 12*a, b* which are slightly offset from being directly radially opposing such that when the disc 10 overlies the disc 9 and one of the apertures 12*a* is aligned with one of the apertures 11*a–d* of the disc 9 the other aperture 12*b* of the disc 10 is adjacent but not aligned with the corresponding aperture 11*a–d* of the adjacent disc 9.

When mounted to the receiver assembly, one of the two reflective discs, 9, 10 is powered to revolve while the other remains static. In consequence whenever alignment occurs between an aperture of one disc with an aperture of the other disc the portion of signal which passes through both apertures is not reflected to the receiver element 1' and is, therefore, interrupted. The slight offset of the opposing apertures 12*a*, 12*b* of disc 10 enables radially opposing portions of the received signal to be interrupted in rapid succession such that paired samples from opposing sides of the receiver element 1' may be taken in corresponding rapid succession. This allows double the frequency of sampling in comparison with use of a disc 10 having only one aperture while weakening the signal by no greater extent than having only 1 aperture 12.

Use of an interrupter device 4' as illustrated in FIGS. 10–12 provides a number of significant advantages. The speed and efficiency of sampling is greatly enhanced and the overall disruption of the received signal by the attenuation thereof is minimised. Use of a cassograin configuration of receiver enables the rotary one of the discs to be powered by a motor mounted behind the reflector 2' thereby avoiding use of complex gearing arrangements and shadowing of the receptive surfaces of the reflector dish 2'.

Although the present invention has been described above primarily with respect to one preferred embodiment numerous alternatives embodiments and modifications within the scope of the invention are possible. The nature of the interrupter device 4 may, as suggested previously, be varied between any of a wide number of different mechanical or electronic analogues.

As suggested earlier, the method and system of the present invention is not only effective when used in monitoring and realignment of a receiver in relation to the source or transmitter but may also be used to realign the transmitter with respect to the receiver. To achieve this one might, for example, monitor misalignment at the receiver and then transmit control signals to the transmitter to adjust the position of the transmitter.

We claim:

1. A tracking system for enabling maintenance of alignment between a receiver of electro-magnetic radiation signals and a source of electro-magnetic radiation signals, the system comprising:

a receiver of electro-magnetic radiation signals, said receiver having a dipole at its center;

a signal strength sensor associated, in use, with the receiver to sense the strength of the signals received by the receiver;

an interrupter device, which is associated in use with said receiver and intermittently operative to obstruct at least one eccentric portion of a signal which is eccentrically offset relative to the dipole of the receiver from being received by the receiver thereby attenuating the received signal by an extent which is dependent upon the degree of misalignment of the receiver from the transmitter;

sampling means for taking one sample of the strength of the signal received by the receiver when the interrupter device is operatively obstructing one eccentric portion of the signal and for taking at least one of a further sample of the signal strength when the interrupter device is operatively obstructing another eccentric portion of the signal and an alternative further sample when the interrupter device is not operative to attenuate an eccentric portion of the signal; and a comparator to compare said one sample of the signal strength with one of said further sample of signal strength and said alternative further sample of signal strength and to generate an output signal corresponding to the difference therebetween.

2. A system as claimed in claim 1, wherein means are provided to synchronise operation of the sensor with operation of the interrupter device.

3. A system as claimed in claim 1 wherein the interrupter device interrupts a pair of portions of the signal being received.

4. A system as claimed in claim 3, wherein the interrupter device interrupts two pairs of portions, each pair lying substantially along a respective one of the horizontal (side-to-side) and vertical (top-to-bottom) axes of the receiver.

5. A system as claimed in claim 1 which further comprises a corrective transport mechanism which acts to re-align the receiver with the transmitter in response to output signals from the comparator.

6. A system as claimed in claim 1 wherein the receiver is of the cassograin-type and includes a dish and a transducer and the interrupter device comprises a reflector onto which the dish of the receiver focuses and which directs the signals received from the source as a focused beam of electro-magnetic radiation to the transducer of the receiver, the reflector having at least one eccentrically offset aperture therein to interrupt portions of the signal, the reflector being rotated, in use, such that signal samples of attenuated signal strength may be taken when the interrupted portion is at different radial positions relative to the focused beam of electro-magnetic radiation.

7. A system as claimed in claim 6 wherein the reflector comprises two reflective plates one mounted behind the other and each having at least one aperture therein corresponding to at least one aperture in the other, one of the plates being stationary in use and the other rotary such that signal strength is only attenuated when the apertures are aligned.

8. A system as claimed in claim 1 which further comprises two receiver elements each adapted to receive respectively horizontally and vertically polarised signals.

9. A system as claimed in claim 8 which comprises a polarotor.

10. A method for monitoring alignment of a receiver of electro-magnetic radiation signals, which receiver has a dipole at the center thereof with a selected source of electro-magnetic radiation signals, which method comprises the steps of:

taking a first sample of the strength of the signal received by the receiver during momentary attenuation of the signal while the signal is obstructed at a first position toward a first side of the dipole of the receiver and taking a further sample of attenuated signal strength during momentary attenuation of the signal while the signal is obstructed at a second position toward the opposing side of the dipole of the receiver; and comparing the the sample taken at the first position and the sample taken at the second position to provide a signal representative of the difference between the two samples and indicative of lateral, or azimuth, error in alignment of the receiver and source.

11. A method as claimed in claim 1, wherein further attenuated signal strength samples are taken when the signal being received is interrupted at third and fourth positions respectively disposed toward the top and bottom, in use, of the receiver; and the attenuated signal strengths corresponding to the third and fourth positions are compared to provide a signal corresponding to the difference between the two sample signal strengths and indicative of elevation errors in alignment between the source and receiver.

12. A method as claimed in claim 10 which further comprises the steps of receiving horizontally polarized signals and vertically polarized signals; sampling the signal strength from each of said signals and comparing the signal strengths to provide a resultant differential signal indicative of rotary phase misalignment of the receiver and source.

13. A system as claimed in claim 1, wherein the interrupter device is arranged to obstruct portions of the signal that are of substantially equal size and which are substantially equidistant radially outwardly from a longitudinal axis of the receiver.

* * * * *